US010029479B2

(12) United States Patent
Aihara

(10) Patent No.: US 10,029,479 B2
(45) Date of Patent: Jul. 24, 2018

(54) TRANSFER APPARATUS

(71) Applicant: Yuichi Aihara, Yamanashi-ken (JP)

(72) Inventor: Yuichi Aihara, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/184,400

(22) Filed: Jun. 16, 2016

(65) Prior Publication Data

US 2016/0368281 A1 Dec. 22, 2016

(30) Foreign Application Priority Data

Jun. 19, 2015 (JP) ..... 2015-123672

(51) Int. Cl.

| | |
|---|---|
| ***B41J 13/00*** | (2006.01) |
| ***B41J 11/00*** | (2006.01) |
| ***B41J 2/325*** | (2006.01) |
| ***B41J 13/12*** | (2006.01) |

(52) U.S. Cl.

CPC ..... *B41J 11/0005* (2013.01); *B41J 2/325* (2013.01); *B41J 13/12* (2013.01)

(58) Field of Classification Search

None

See application file for complete search history.

(56) References Cited

U.S. PATENT DOCUMENTS

2011/0182642 A1* 7/2011 Nanayama ..... G03G 15/231 399/406
2014/0354752 A1* 12/2014 Aihara ..... B41J 2/325 347/217
2015/0336396 A1* 11/2015 Aihara ..... B41J 11/0005 347/217

FOREIGN PATENT DOCUMENTS

JP 2008-080682 A 4/2008
JP 2011-136783 A 7/2011

* cited by examiner

*Primary Examiner* — Alejandro Valencia
(74) *Attorney, Agent, or Firm* — Manabu Kanesaka

(57) ABSTRACT

The present invention is to provide a transfer apparatus which can effectively correct a curl of a card and prevent deterioration of the card.

The transfer apparatus transfers a transfer layer of a transfer film with a transfer roller to both faces of a card, a transfer unit which includes the transfer roller is structured to perform transfer processing for a plurality of times on at least one face of the card. A controller performs control to perform decurl processing with a decurl mechanism when determining that a transfer face on which the current transfer processing is performed and a transfer face on which the subsequent transfer processing is to be performed are the same and that the card is curled after the current transfer processing is performed.

8 Claims, 10 Drawing Sheets

FIG. 7

| Front face: twice<br>Back face: once | | First | Decurling | Second | Decurling | Third | Decurling | Number of times of decurling |
|---|---|---|---|---|---|---|---|---|
| Pattern 1 | Transfer sequence | Front | – | Back | – | Front | ◎ | 1 |
| | Curl level value | 1 | | 0 | | 1 | 0 | |
| Pattern 2 | Transfer sequence | Front | ◎ | Front | – | Back | – | 1 |
| | Curl level value | 1 | 0 | 1 | | 0 | | |
| Pattern 3 | Transfer sequence | Back | – | Front | – | Front | ◎ | 1 |
| | Curl level value | −1 | | 0 | | 1 | 0 | |

FIG. 8

| Front face: three times<br>Back face: once | | First | Decurling | Second | Decurling | Third | Decurling | Fourth | Decurling | Number of times of decurling |
|---|---|---|---|---|---|---|---|---|---|---|
| Pattern 1 | Transfer sequence | Front | – | Back | – | Front | ◎ | Front | ◎ | 2 |
| | Curl level value | 1 | | 0 | | 1 | 0 | 1 | 0 | |
| Pattern 2 | Transfer sequence | Front | ◎ | Front | – | Back | – | Front | ◎ | 2 |
| | Curl level value | 1 | 0 | 1 | | 0 | | 1 | 0 | |
| Pattern 3 | Transfer sequence | Front | ◎ | Front | ◎ | Front | – | Back | – | 2 |
| | Curl level value | 1 | 0 | 1 | 0 | 1 | | 0 | | |
| Pattern 4 | Transfer sequence | Back | – | Front | – | Front | ◎ | Front | ◎ | 2 |
| | Curl level value | −1 | | 0 | | 1 | 0 | 1 | 0 | |

FIG. 9

| Front face: twice<br>Back face: twice | | First | Decurling | Second | Decurling | Third | Decurling | Fourth | Decurling | Number of times of decurling |
|---|---|---|---|---|---|---|---|---|---|---|
| Pettern 1 | Transfer sequence | Front | – | Back | – | Front | – | Back | – | 0 |
| | Curl level value | 1 | | 0 | | 1 | | 0 | | |
| Pettern 2 | Transfer sequence | Front | – | Back | – | Back | – | Front | – | 0 |
| | Curl level value | 1 | | 0 | | −1 | | 0 | | |
| Pettern 3 | Transfer sequence | Back | – | Front | – | Front | – | Back | – | 0 |
| | Curl level value | −1 | | 0 | | 1 | | 0 | | |
| Pettern 4 | Transfer sequence | Back | – | Front | – | Back | – | Front | – | 0 |
| | Curl level value | −1 | | 0 | | −1 | | 0 | | |
| Pettern 5 | Transfer sequence | Front | ◎ | Front | – | Back | – | Back | ◎ | 2 |
| | Curl level value | 1 | 0 | 1 | | 0 | | −1 | 0 | |
| Pettern 6 | Transfer sequence | Back | ◎ | Back | – | Front | – | Front | ◎ | 2 |
| | Curl level value | −1 | 0 | −1 | | 0 | | 1 | 0 | |

FIG. 10

| Front face: three times<br>Back face: twice | | First | Decurling | Second | Decurling | Third | Decurling | Fourth | Decurling | Fifth | Decurling | Number of times of decurling |
|---|---|---|---|---|---|---|---|---|---|---|---|---|
| Pattern 1 | Transfer sequence | Front | – | Back | – | Front | – | Back | – | Front | ◎ | 1 |
| | Curl level value | 1 | | 0 | | 1 | | 0 | | 1 | 0 | |
| Pattern 2 | Transfer sequence | Front | – | Back | – | Back | – | Front | – | Front | ◎ | 1 |
| | Curl level value | 1 | | 0 | | −1 | | 0 | | 1 | 0 | |
| Pattern 3 | Transfer sequence | Back | – | Front | – | Front | – | Back | – | Front | ◎ | 1 |
| | Curl level value | −1 | | 0 | | 1 | | 0 | | 1 | 0 | |
| Pattern 4 | Transfer sequence | Back | – | Front | – | Back | – | Front | – | Front | ◎ | 1 |
| | Curl level value | −1 | | 0 | | −1 | | 0 | | 1 | 0 | |
| Pattern 5 | Transfer sequence | Front | ◎ | Front | – | Back | – | Front | – | Back | – | 1 |
| | Curl level value | 1 | 0 | 1 | | 0 | | 1 | | 0 | | |
| Pattern 6 | Transfer sequence | Back | – | Front | – | Front | ◎ | Front | – | Back | – | 1 |
| | Curl level value | −1 | | 0 | | 1 | 0 | 1 | | 0 | | |
| Pattern 7 | Transfer sequence | Front | ◎ | Front | – | Back | – | Back | – | Front | – | 1 |
| | Curl level value | 1 | 0 | 1 | | 0 | | −1 | | 0 | | |
| Pattern 8 | Transfer sequence | Front | ◎ | Front | ◎ | Front | – | Back | – | Back | ◎ | 3 |
| | Curl level value | 1 | 0 | 1 | 0 | 1 | | 0 | | −1 | 0 | |
| Pattern 9 | Transfer sequence | Back | ◎ | Back | – | Front | – | Front | ◎ | Front | ◎ | 3 |
| | Curl level value | −1 | 0 | −1 | | 0 | | 1 | 0 | 1 | 0 | |

TRANSFER APPARATUS

BACKGROUND OF THE INVENTION

1. Field of the Invention

The present invention relates to a transfer apparatus, and in particular, relates to a transfer apparatus which transfers an image to a card-shaped recording medium.

2. Description of Related Art

Conventionally, there has been widely known a transfer apparatus which transfers an image (mirror image) formed on a transfer film to a card using a heat roller (HR). In general, in such a transfer apparatus, a configuration in which a transfer film and a card are conveyed simultaneously (at the same speed) while a face of the transfer film at the opposite side of a transfer layer is pressed by a heat roller is adopted.

In such a transfer apparatus, transfer processing is performed by applying heat to the card and the transfer film with the heat roller to transfer the transfer layer of the transfer film to the card, and peeling the transfer film from the card. Then, a curl occurs with contraction of the transfer film as the transferred card and the transfer film get cooled. Accordingly, the transfer apparatus includes a decurl mechanism to correct a curl of the card and decurl processing is performed to correct a curl of the card using the decurl mechanism after an image is transferred to the card.

For example, Japanese Patent Application Laid-open No. 2011-136783 discloses a technology to perform decurl processing on a card by pressing down a decurl unit (pressing member) for a time set by a user after conveying the card to a decurl mechanism and stopping the card at a central arrival point. In this technology, as illustrated in FIG. 12, a curl of a card, where the card has an image transferred on one face (lower face in FIG. 12) side, is corrected (removed) by pressing the other face (upper face in FIG. 12) side of the card having a curl with a pressing member configuring the decurl mechanism for a predetermined time. Then, the card is rotated by 180 degrees (i.e., faces are reversed) and an image is transferred to the other face (lower face in FIG. 12) side, and then, the one face (upper face in FIG. 12) side having a curl is pressed for a predetermined time by the pressing member. Thus the curl is corrected. According to the technology disclosed in Japanese Patent Application Laid-open No. 2011-136783, a card with excellent handling and good-looking is provided by correcting a curl of the card with a decurl unit for each time after transfer processing is performed.

Further, in Japanese Patent Application Laid-open No. 2008-080682, transfer processing is performed for a plurality of times on one face of a card with a transfer apparatus which transfers an image formed on a transfer film to the card using a heat roller.

SUMMARY OF THE INVENTION

In the decurl mechanism of Japanese Patent Application Laid-open No. 2011-136783, a curl is corrected by pressing a card with the pressing member in a direction opposite to the curling direction.

Accordingly, damage to the card increases as the pressing time is elongated and the card is pressed for a plurality of times with load put on the card. For example, in the technology disclosed in Japanese Patent Application Laid-open No. 2008-080682, since transfer processing is performed for a plurality of times on one face of a recording medium, decurl processing has to be performed for a plurality of times on the card if decurl processing is performed for each time after transfer processing is performed as disclosed in Japanese Patent Application Laid-open No. 2011-136783. Here, there is a fear that damage to the card may increase.

In view of the above, an object of the present invention is to provide a transfer apparatus capable of effectively correcting a curl of a card-shaped recording medium and prevent deterioration of the card-shaped recording medium.

In view of the above, a transfer apparatus of the present invention includes a transfer device which performs transfer processing to transfer a transfer layer of a transfer film or a protection film for a plurality of times on at least one of a first face and a second face of a card-shaped recording medium, a correcting device which performs decurl processing to correct a curl of the recording medium to which the transfer layer is transferred with the transfer device, and a control device which controls the transfer device and the correcting device, wherein the control device determines whether to perform decurl processing with the correcting device after the current transfer processing is performed based on information of comparison between the transfer face of the recording medium on which the current transfer processing is performed and the transfer face on which the subsequent transfer processing is to be performed and information of whether the recording medium is curled after the current transfer processing is performed.

The control device performs decurl processing with the correcting device after the current transfer processing is performed when determining that the transfer face of the recording medium on which the current transfer processing is performed and the transfer face on which the subsequent transfer processing is to be performed are the same and that the recording medium is curled after the current transfer processing is performed.

According to the present invention, the control device determines whether to perform decurl processing with the correcting device after the current transfer processing is performed based on information of comparison between the transfer face of the recording medium on which the current transfer processing is performed and the transfer face on which the subsequent transfer processing is to be performed and information of whether the recording medium is curled after the current transfer processing is performed. Thus, unnecessary decurl processing may not be performed. Accordingly, a curl of a card-shaped recording medium can be effectively corrected and deterioration of the recording medium can be prevented.

BRIEF DESCRIPTION OF THE DRAWINGS

FIGS. 3A and 3B are explanatory views of a principle of image transferring, while FIG. 3A illustrates a state in which a transfer member, a peeling member, and a supporting member are placed respectively at an operating position, and FIG. 3B illustrates a state in which the above are placed respectively at a retracting position.

FIGS. 5A to 5C are explanatory views schematically illustrating decurl operation of a decurl mechanism of the printing apparatus according to the embodiment, while FIG. 5A illustrates a state in which the pressing member is placed at the retracting position being separated from the supporting member, FIG. 5B illustrates a decurl state in which the pressing member proceeds to the supporting member, and FIG. 5C illustrates a state in which the pressing member presses the supporting member to the utmost extent among the decurl states illustrated in FIG. 5B.

FIG. 7 is a chart showing patterns of sequence of transfer processing and timing of decurl processing, in a case that transfer processing is performed twice on a front face of the card and once on a back face.

FIG. 8 is a chart showing patterns of sequence of transfer processing and timing of decurl processing, in a case that transfer processing is performed for three times on the front face of the card and once on the back face.

FIG. 9 is a chart showing patterns of sequence of transfer processing and timing of decurl processing, in a case that transfer processing is performed twice on the front face of the card and twice on the back face.

FIG. 10 is a chart showing patterns of sequence of transfer processing and timing of decurl processing, in a case that transfer processing is performed for three times on the front face of the card and twice on the back face.

DETAILED DESCRIPTION OF THE PREFERRED EMBODIMENT

In the following, description will be provided on embodiments in which the present invention is applied to a printing apparatus which prints a character or an image on a card (card-shaped recording medium made of PVC material or the like) and magnetically or electrically records information in the card.

[System Configuration]

Figure 1:
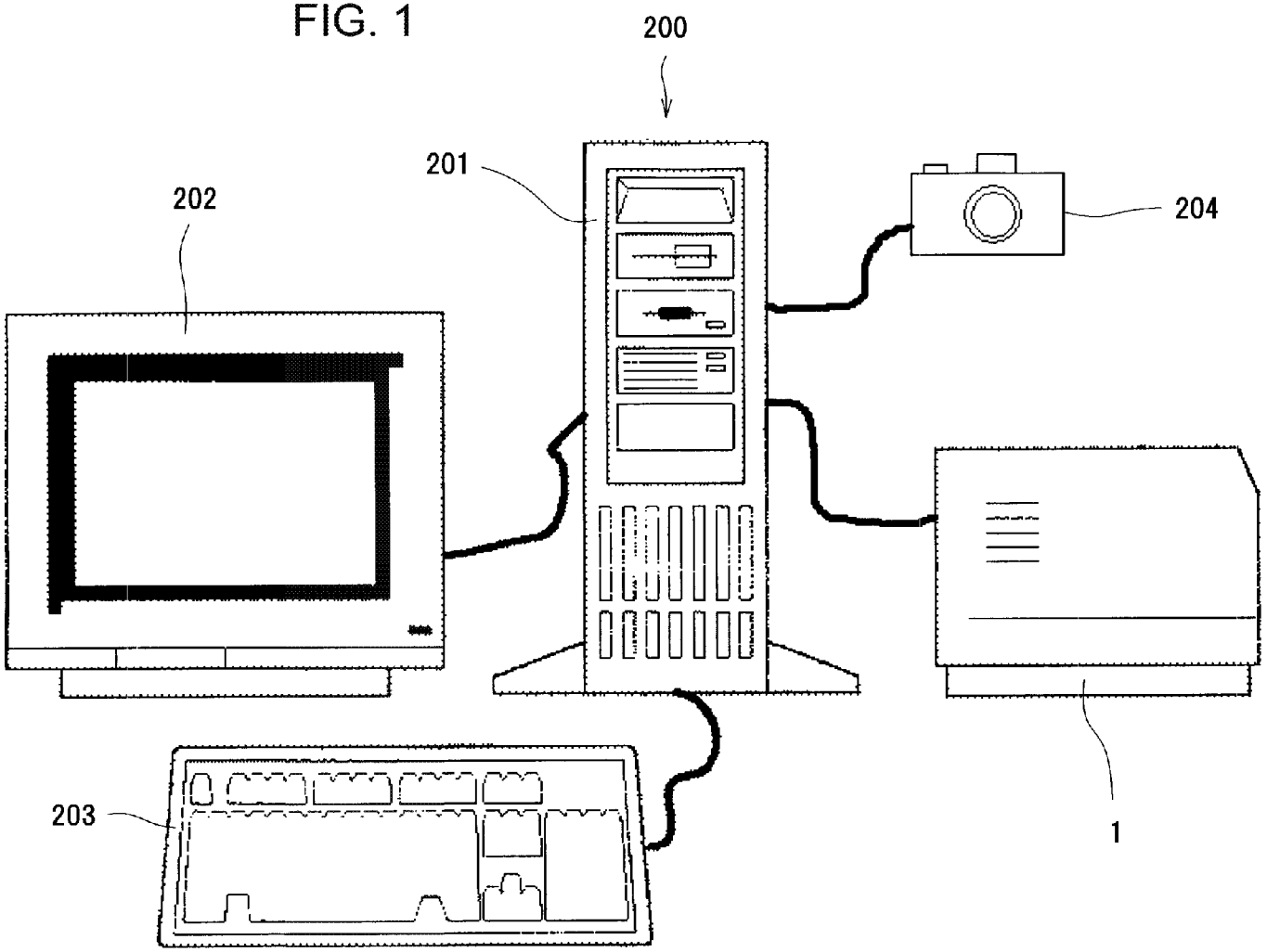
FIG. 1 is an external view of a printing system including a printing apparatus according to an applicable embodiment of the present invention.
Figure 6:
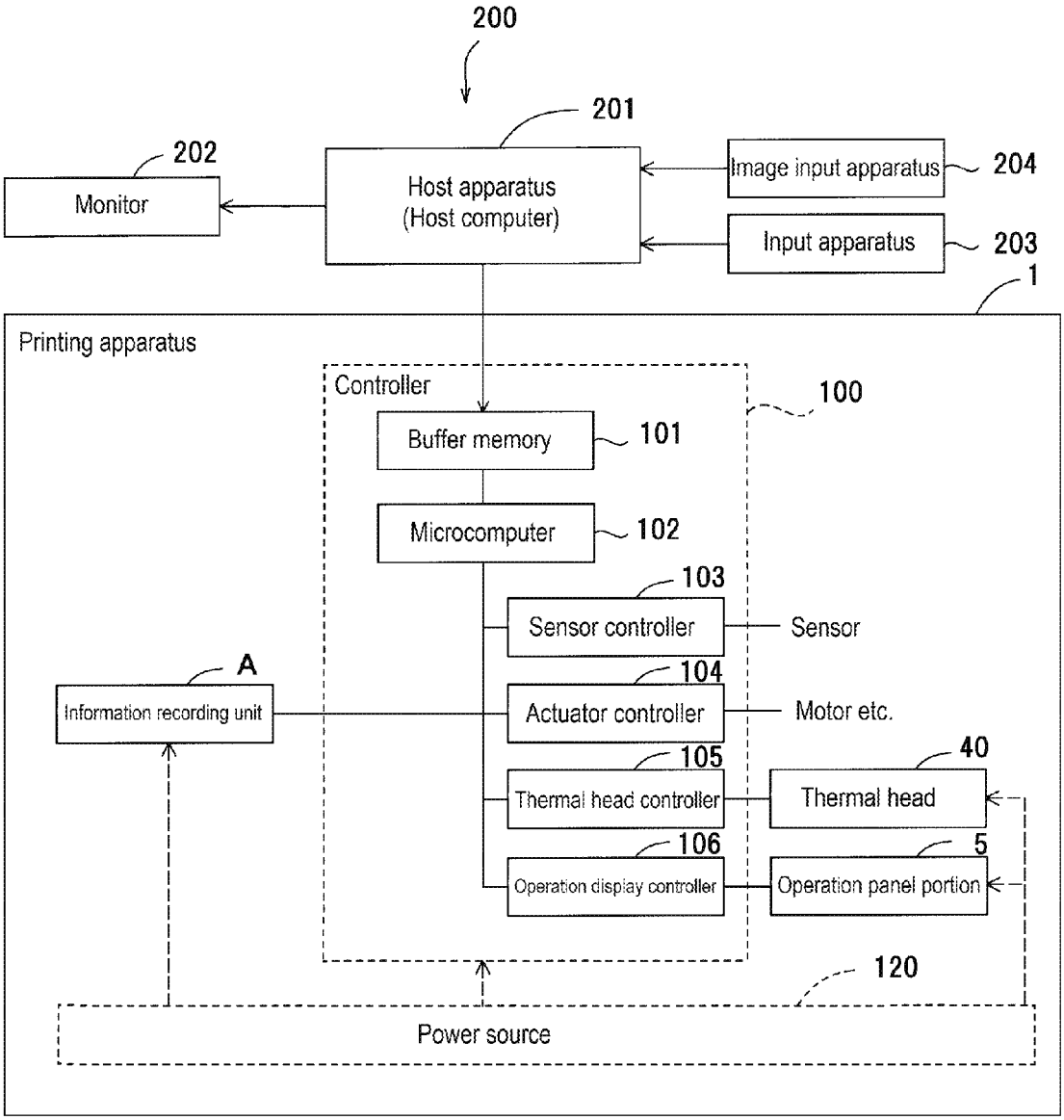
FIG. 6 is a block diagram illustrating a schematic structure of a controller of the printing apparatus according to the embodiment.

As illustrated in FIG. 1 and FIG. 6, a printing apparatus 1 of the present embodiment structures a part of a printing system 200. That is, the printing system 200 is structured with a host apparatus 201 (i.e., a host computer such as a personal computer) and the printing apparatus 1, divided roughly.

The printing apparatus 1 is connected to the host apparatus 201 via an unillustrated interface. It is possible to send image data, magnetically or electrically recorded data, and the like and to instruct recording operation and the like from the host apparatus 201 to the printing apparatus 1. Here, the printing apparatus 1 includes an operation panel (operation displaying portion) 5 (see FIG. 6). Recording operation and the like can be instructed from the operation panel 5 in addition to instructing from the host apparatus 201.

An image input apparatus 204 such as a digital camera and a scanner, an input apparatus 203 such as a keyboard and a mouse to input a command and data to the host apparatus 201, and a monitor 202 such as a liquid crystal display which displays data and the like generated by the host apparatus 201 are connected to the host apparatus 201.

[Printing Apparatus]

Figure 2:
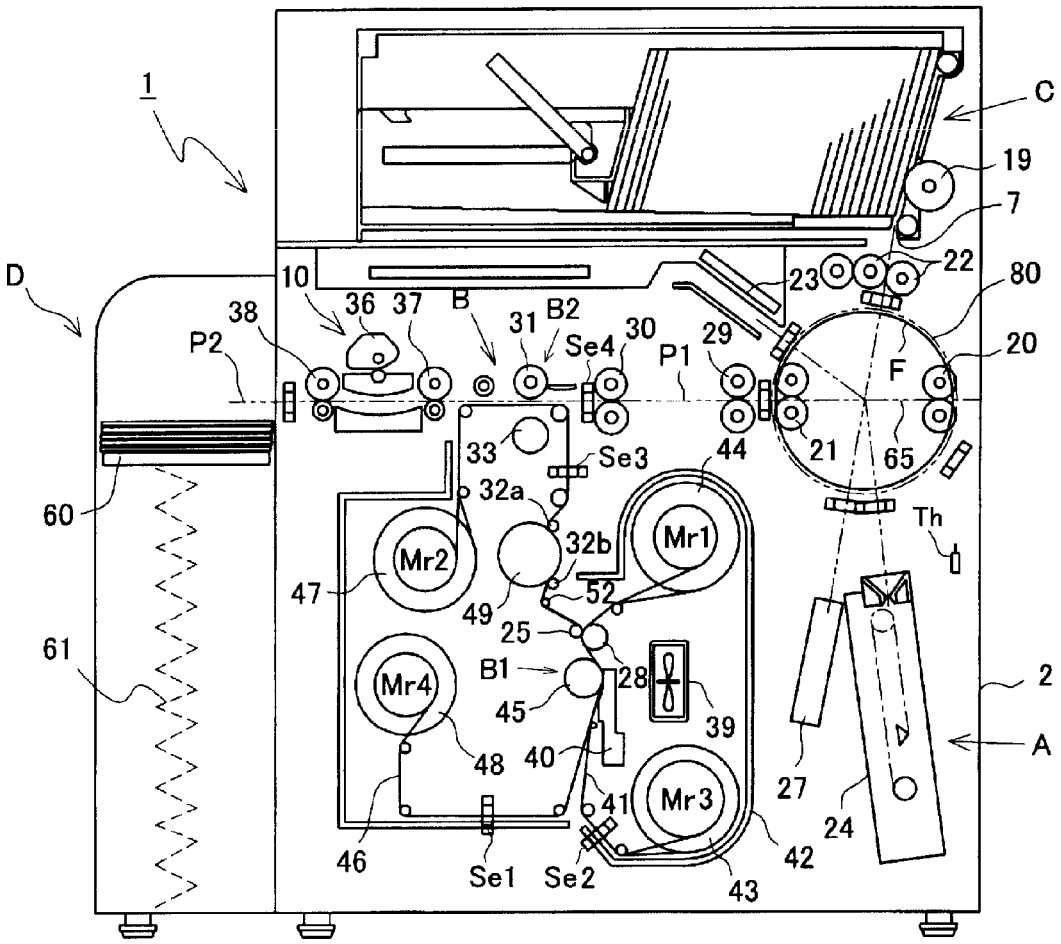
FIG. 2 is a schematic structural view of the printing apparatus according to an embodiment.

As illustrated in FIG. 2, the printing apparatus 1 includes a housing 2. An information recording unit A, a printing unit B, a medium accommodating unit C, an accommodating unit D, and a rotating unit F are provided in the housing 2.

[Information Recording Unit]

The information recording unit A is structured with a magnetic recording portion 24, a non-contact type IC recording portion 23, and a contact type IC recording portion 27.

[Medium Accommodating Unit]

The medium accommodating unit C accommodates a plurality of cards aligned in a standing posture. A separating opening 7 is arranged at a leading end of the medium accommodating unit C and a foremost card is sequentially fed out and supplied with a pickup roller 19.

[Rotating Unit]

A blank card fed out is sent to the rotating unit F with a conveying roller 22. The rotating unit F is structured with a rotating frame 80 which is axially supported by the housing 2 in a rotatable manner, and two roller pairs 20, 21 supported by the rotating frame 80. The roller pairs 20, 21 are axially supported by the rotating frame 80 in a rotatable manner.

The magnetic recording portion 24, the non-contact type IC recording portion 23, and the contact type IC recording portion 27, described above, are arranged at the outer circumference of a rotation of the rotating unit F. The roller pairs 20, 21 form a medium conveying path 65 for conveying a card to any one of the information recording portions 23, 24, 27. Data is magnetically or electrically written to the card at the information recording portion 23, 24, 27. Here, a temperature sensor Th such as a thermistor which detects environmental temperature (outer temperature) is arranged in the vicinity of the rotating unit F.

[Printing Unit]

The printing unit B forms an image such as a head shot and character data on front-back faces of a card. A medium conveying path P1 to convey a card onto the extension of the medium conveying path 65 is arranged at the printing unit B. Further, conveying roller pairs 29, 30 which convey a card are arranged at the medium conveying path P1 and an unillustrated conveying motor is connected thereto.

The printing unit B includes a film-shaped medium conveying mechanism, an image forming unit B1 which forms an image on a transfer film 46 conveyed by the conveying mechanism with a thermal head 40, and a transfer unit B2 which transfers the image formed on the transfer film 46 to a surface of a card at the medium conveying path P1 with a heat roller 33.

A medium conveying path P2 which conveys a printed card to an accommodating stacker 60 is arranged at the downstream side of the printing unit B on the extension of the medium conveying path P1. Conveying roller pairs 37, 38 which convey a card are arranged at the medium conveying path P2 and an unillustrated conveying motor is connected thereto.

A decurl mechanism 10 is arranged between the conveying roller pair 37 and the conveying roller pair 38. The decurl mechanism 10 corrects a curl occurred on a card due to thermal transfer with the heat roller 33 by pressing a center part of the card being nipped by the conveying roller pairs 37, 38 at both ends. The decurl mechanism 10 includes an eccentric cam 36 and is structured as being capable of moving in a vertical direction in FIG. 2. Detailed description will be provided later.

[Accommodating Unit]

The accommodating unit D is structured to accommodate a card in the accommodating stacker 60 sent from the printing unit B. The accommodating stacker 60 is structured to move downward in FIG. 2 with a lifting mechanism 61.

[Detail of Printing Unit]

Next, the printing unit B in the whole structure of the abovementioned printing apparatus 1 will be further described in detail.

The transfer film 46 is belt-shaped having a width slightly wider than the width of a card. The transfer film 46 is formed by layering an ink receptor layer which receives ink of an ink ribbon 41, a transparent protection layer which protects the surface of the ink ribbon layer, a peeling layer which stimulates to integrally peel the ink receptor layer and the protection layer with heating, and a base material (base film) in this order from the above. The ink receptor layer and the protection layer are collectively called a transfer layer.

The transfer film 46 is wound and fed respectively with a winding roller and a feeding roller which rotate in a transfer film cassette by driving motors Mr2, Mr4. That is, in the transfer film cassette, a winding spool 47 is arranged at the center of the winding roller and the supplying spool 48 is arranged at the center of the feeding roller. Rotational driving force of the motor Mr2 is transmitted to the winding spool 47 via an unillustrated gear and rotational driving force of the motor Mr4 is transmitted to the supplying spool 48 via an unillustrated gear. A film conveying roller 49 is a main driving roller for conveying the transfer film 46. Conveying amount and convey stopping position of the transfer film 46 are determined by controlling the driving of the film conveying roller 49. The film conveying roller 49 is connected to an unillustrated stepping motor. The motors Mr2, Mr4 are driven when the film conveying roller 49 is driven. However, the motors Mr2, Mr4 are intended to be driven to wind the transfer film 46 with one of the winding spool 47 or the supplying spool 48 fed from the other thereof but are not driven to subjectively convey the transfer film 46. Here, a DC motor capable of forward-reverse driving is used for each of the motors Mr2, Mr4.

A pinch roller 32*a* and a pinch roller 32*b* are arranged at the circumferential face of the film conveying roller 49. Although not illustrated in FIG. 2, the pinch rollers 32*a*, 32*b* are structured to be capable of moving to proceed to and retract from the film conveying roller 49. FIG. 2 illustrates a state that the pinch rollers 32*a*, 32*b* proceed to the film conveying roller 49 so that the transfer film 46 is pressure-contacted and wound to the film conveying roller 49. Thus, the transfer film 46 is accurately conveyed by a distance corresponding to a number of rotations of the film conveying roller 49.

The ink ribbon 41 is accommodated in an ink ribbon cassette 42 in a stretched state between a supplying spool 43 which supplies the ink ribbon 41 to the ink ribbon cassette 42 and a winding spool 44 which winds the ink ribbon 41. The winding spool 44 is rotated by driving force of a motor Mr1 and the supplying spool 43 is rotated by driving force of a motor Mr3. A DC motor capable of forward-reverse driving is used for each of the motors Mr1, Mr3. Here, the temperature sensor Th such as a thermistor which detects environmental temperature of the motors Mr1, Mr3 is arranged between the motor Mr1 and the motor Mr3.

The ink ribbon 41 is configured to sequentially feed faces of color ribbon panels of yellow (Y), magenta (M), and cyan (C) and a black (B) ribbon panel in the longitudinal direction. Here, the ink ribbon 41 may be configured to sequentially feed faces of ultraviolet (UV) or another black ribbon panel in addition to the color ribbon panels of yellow (Y), magenta (M), and cyan (C) and the black (B) ribbon panel in the longitudinal direction depending on types. An empty mark indicating application limits of the ink ribbon 41 is set at a termination of the ink ribbon 41. Se2 indicated in FIG. 2 is a transparent sensor to detect the empty mark.

The image forming unit B1 is structured with a platen roller 45 and the thermal head 40. The thermal head 40 is arranged at a position faced to the platen roller 45. The thermal head 40 includes heating elements arranged in lines in a main scanning direction. The heating elements are selectively heat controlled with an unillustrated head control IC in accordance with printing data and an image is printed on the transfer layer of the transfer film 46 via the ink ribbon 41. A cooling fan 39 is provided to cool the thermal head 40.

The ink ribbon 41 with which printing to the transfer film 46 is completed is peeled from the transfer film 46 with a peeling roller 25 and a peeling member 28. The peeling member 28 is fixed to the ink ribbon cassette 42. The peeling roller 25 is abutted to the peeling member 28 at the time of printing and peeling is performed by nipping the transfer film 46 and the ink ribbon 41 with the peeling roller 25 and the peeling member 28. Then, the peeled ink ribbon 41 is wound by the winding spool 44 with the driving force of the motor Mr1 and the transfer film 46 is conveyed, with the film conveying roller 49, to the transfer unit B2 which includes a platen roller 31 and the heat roller 33.

At the transfer unit B2, the transfer film 46 is nipped by the heat roller 33 and the platen roller 31 along with a card. Then, the image formed on the transfer layer of the transfer film 46 is transferred to the card. When starting transfer processing, the transfer film 46 is placed at a transfer starting position as being conveyed by a predetermined distance after a mark formed on the transfer film 46 is detected by a sensor Se3. The front end of the card is placed at the transfer starting position as being conveyed by a predetermined distance after the front end of the card is detected by a sensor Se4. Thus, positioning of the transfer film 46 and the card is performed and transfer processing is started. Here, the heat roller 33 is attached to an unillustrated lifting mechanism to pressure-contact to and be separated from the platen roller 31 via the transfer film 46.

Figure 3A:
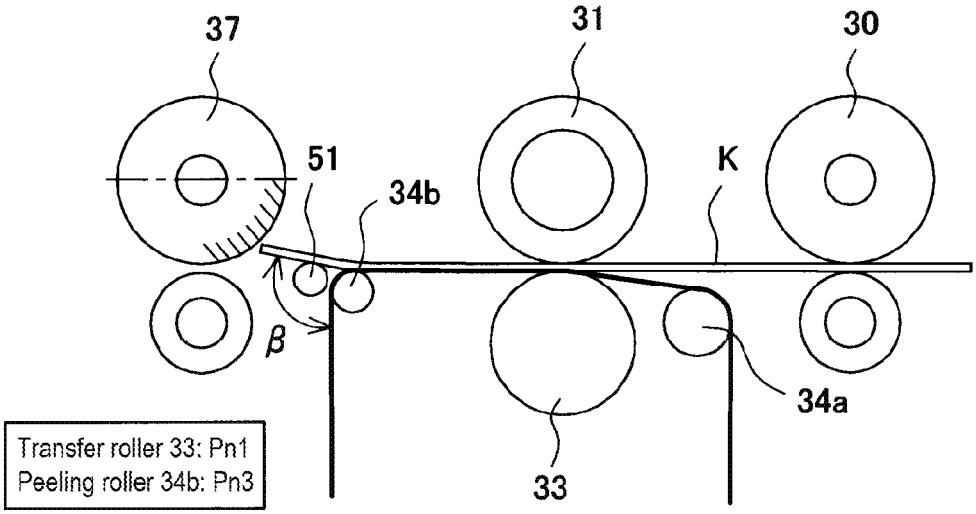
Figure 3B:
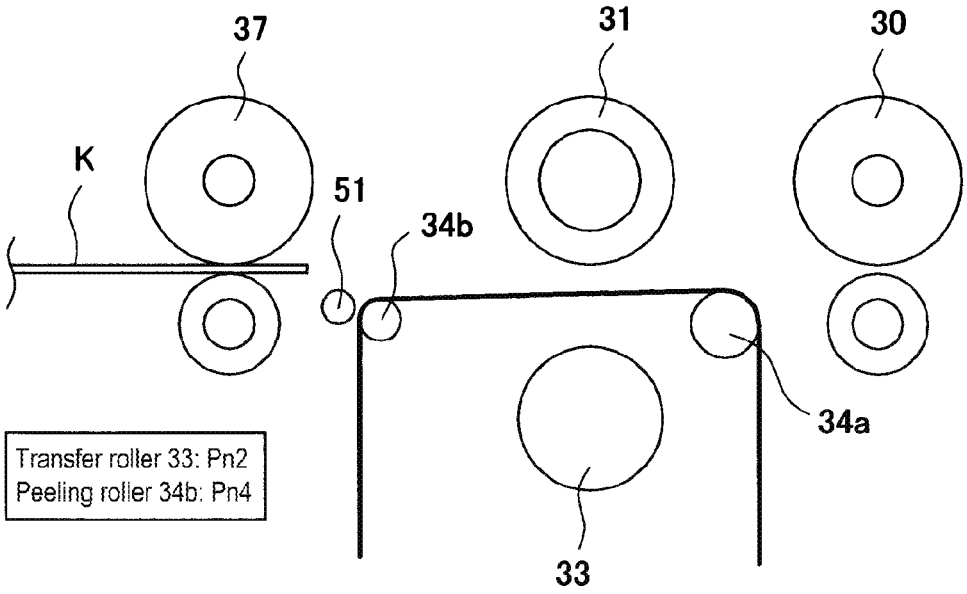

The transfer roller 33, a peeling roller 34*b*, and a supporting pin 51 are structured to be capable of moving respectively to an operating position illustrated in FIG. 3A and a retracting position illustrated in FIG. 3B with an unillustrated lifting mechanism. The peeling roller 34*b* and the supporting pin 51 are arranged at the transfer film cassette. The peeling roller 34*b* moves to the operating position and the retracting position while supporting the transfer film 46. The peeling roller 34*b* at the operating position is set to contact to the card conveyed along the conveying path P1 via the transfer film 46. The transfer film 46 being transferred to the card adheres to the card from the position of the transfer roller 33 to the peeling roller 34*b* and is peeled from the card when the card reaches the position of the peeling roller 34*b*. Since the peeled transfer film 46 is wound to a direction perpendicular to the card (downward in FIG. 2), the card and the peeled transfer film 46 are kept in a relation of approximately 90 degrees via the peeling roller 34*b*. That is, a peeling angle β is approximately 90 degrees.

A later-mentioned controller 100 moves the transfer roller 33 to the operating position (Pn1) to pressure-contact the card when transferring an image to the card and moves the transfer roller 33 to the retracting position (Pn2) to be separated from the card after forming the image (after the rear end of the card passes the transfer roller 33). Accordingly, deformation of the transfer film 46 due to the heat of the transfer roller (heat roller) 33 can be prevented as the transfer film 46 is prevented from being contacted to the transfer roller 33 after the rear end of the card passes the transfer roller 33.

The controller 100 moves the peeling roller 34*b* and the supporting pin 51, respectively, from the operating position (Pn3) to the retracting position (Pn4) at the timing when the rear end of the card passes the supporting pin 51. Here, since the peeling roller 34*b* and the supporting pin 51 are moved respectively to the retracting position, collision of the card with the supporting pin 51 and the peeling roller 34*b* is prevented when the card is switch back conveyed to a reverse unit F at the upstream side of the conveying path for duplex printing. According to such control, there is not a fear that excessive heat effects to deform the transfer film and transfer malfunction does not occur when peeling the transfer film 46.

In the present embodiment, transfer processing is performed for a plurality of times at least on one face of the card at the transfer unit B2. For example, in a case that a color image and the protection layer is transferred to a front face (first face) of the card and a black-and-white image is transferred to a back face (second face) of the card, transfer processing is performed twice on the front face and once on the back face at the transfer unit B2. Here, transferring the protection layer is to coat the card by transferring the transfer layer of the transfer film 46 at the transfer unit B2 without forming an image at the image forming unit B1. Further, in a case that a UV ink image, a color image, and the protection layer are transferred to the front face and a black-and-white image and the protection layer are transferred to the back face, transfer processing is performed for three times on the front face and twice on the back face at the transfer unit B2. The above can be arbitrarily set by a user. For example, transfer processing may be performed twice on the front face and twice on the back face, or once on the front face and three times on the back face.

Figure 4:
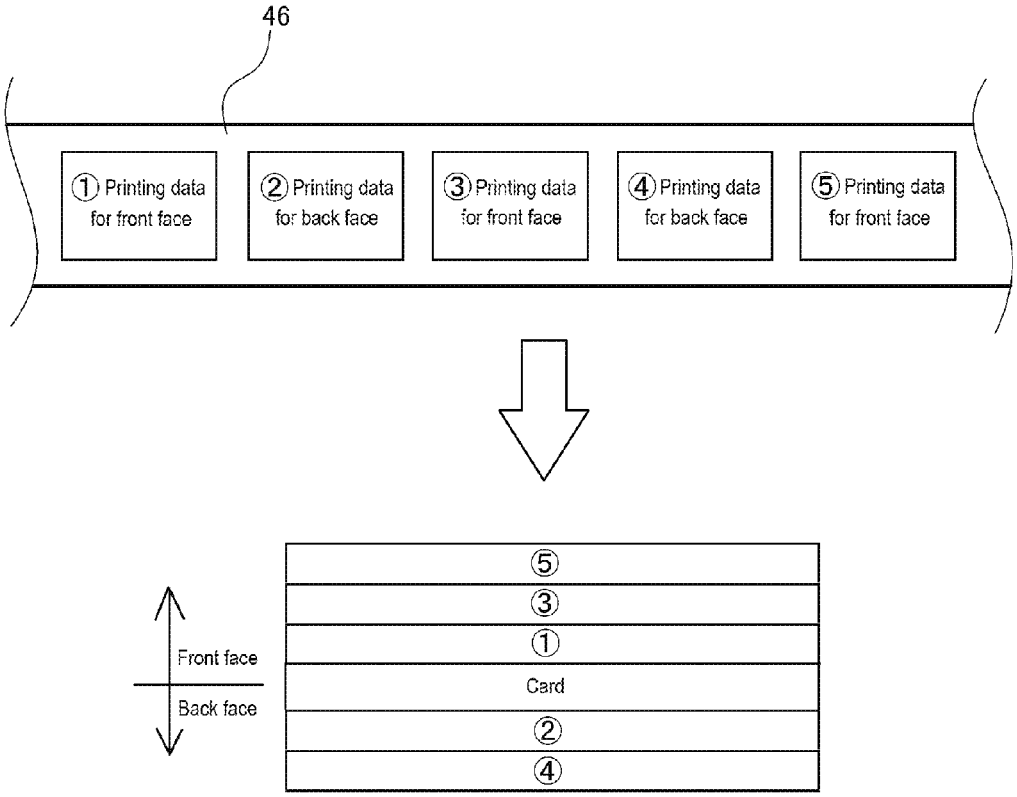
FIG. 4 is a view illustrating a card issued by the printing apparatus according to the embodiment and a sequence of primary transferring to perform transfer processing on the card.

For example, in a case that transfer processing is performed for three times on the front face of the card and twice on the back face, as illustrated in FIG. 4, at the image forming unit B1, printing data for the front face is formed at three parts on the transfer film 46 and at two parts for the back face. Then, transfer processing is performed for a plurality of times on the card at the transfer unit B2, and then, the card is issued. In the example illustrated in FIG. 4, transfer processing is performed in the order of the front face 1, the back face 1, the front face 2, the back face 2, and the front face 3. Accordingly, image forming is performed on the transfer film 46 in the same order. That is, the order of printing on the transfer film 46 at the image forming unit B1 varies in accordance with the order of performing transfer processing on the card at the transfer unit B2. Here, in a case that transfer processing is performed on the same face of the card for a plurality of times, image forming on the transfer film 46 is performed from printing data close to the card.

[Detail of Decurl Mechanism]

Figure 5A:
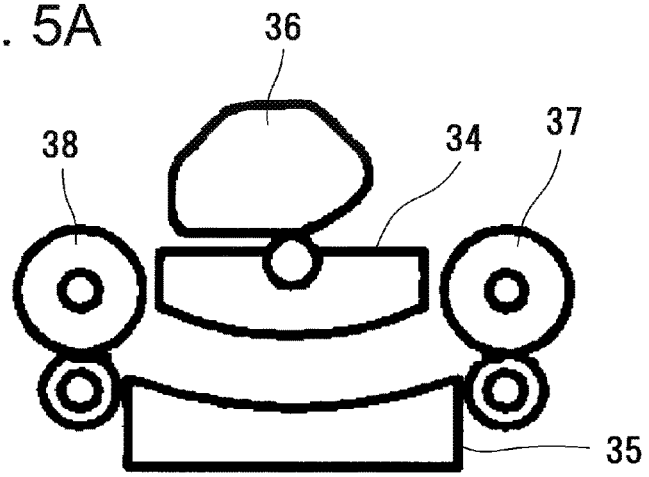
Figure 5B:
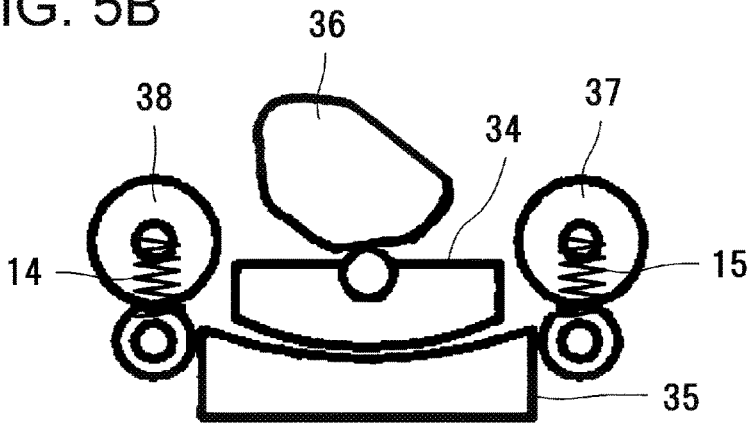
Figure 5C:
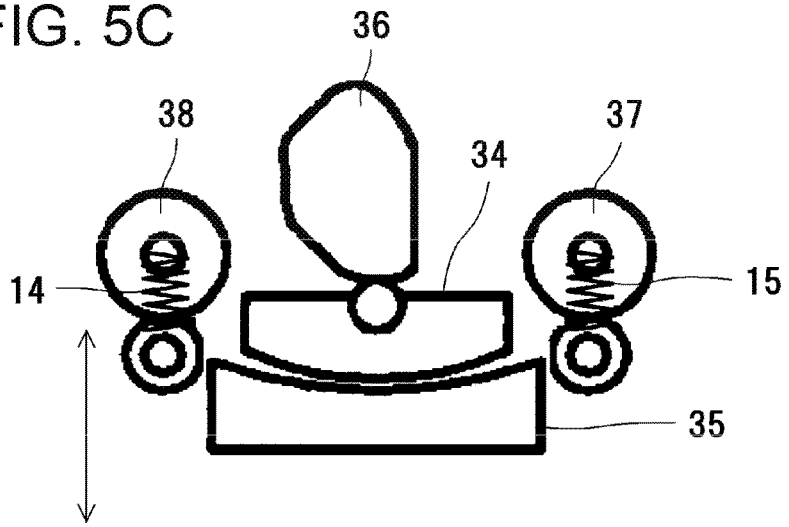

Next, the abovementioned decurl mechanism 10 will be described in detail. As illustrated in FIGS. 5A to 5C, the decurl mechanism 10 includes the eccentric cam 36, the pressing member 34 which has a convex curved face, and a supporting member 35 which has a concave curved face corresponding to the curved face of the pressing member 34.

As illustrated in FIG. 5A, when the decurl mechanism 10 is not in operation, the pressing member 34 is positioned at a retracting position and the pressing member 34 and the supporting member 35 are arranged to be separated as facing each other via the medium conveying path P2 (see FIG. 2). A roller is fixedly attached to the pressing member 34 at the center part of a face opposite to the convex curved face and the roller is abutted to the circumferential face of the eccentric cam 36. Rotational driving force of an unillustrated motor is transmitted to the axis center of the eccentric cam 36 (see FIG. 2) via unillustrated gears.

The eccentric cam 36 is rotated with the rotational driving force of the unillustrated motor transmitted to the axis center of the eccentric cam 36 while the card is nipped at both ends thereof by the conveying roller pairs 37, 38. Thus, as illustrated in FIG. 5B, the pressing member 34 proceeds to the supporting member 35 side crossing over the medium conveying path P2. Accordingly, in the present embodiment, the card is sandwiched between the concave curved face of the supporting member 35 and the convex curved face of the pressing member 34, and a curl opposite to a curl of the card is applied to the card by the pressing member 34 and the supporting member 35, so that the curl of the card is corrected.

FIG. 5C illustrates a state in which the pressing member 34 presses the supporting member 35 to the utmost extent among the decurl states illustrated in FIG. 5B. Driven rollers (rollers at the lower side in FIG. 5C) which constitute the supporting member 35 and the conveying roller pairs 37, 38 are arranged in a slidable manner in a direction intersecting with the medium conveying path P2 as an arrow indicated in FIG. 5C (the vertical direction in FIG. 5C) and are urged to the pressing member 34 side with springs 14, 15. Here, the supporting member 35 is fixed to a bearing of the conveying roller pairs 37, 38 at the driven roller side. In the present embodiment, the time of decurl processing is set to 10 seconds for each time. However, the time of decurl processing can be appropriately set in accordance with a material and thickness of the card or environmental temperature. The time of decurl processing can be determined so that a curl of the card is corrected while negative influence to conveying of the card and transfer processing does not occur.

Next, the control and electrical system of the printing apparatus 1 will be described. As illustrated in FIG. 6, the printing apparatus 1 includes a controller 100 which controls the whole operation of the printing apparatus 1, and a power source 120 which converts commercial alternating current power source to a direct current power source being capable of driving and operating each of mechanisms, controller, and the like.

[Controller]

As illustrated in FIG. 6, the controller 100 includes a microcomputer 102 which performs control processing of the whole printing apparatus 1. The microcomputer 102 is structured with a CPU which operates as a central processing unit at high-speed clock, a ROM which stores a program and program data of the printing apparatus 1, a RAM which functions as a work area of the CPU, and an internal bus which connects the above.

The microcomputer 102 is connected to an external bus. The external bus is connected to an unillustrated interface which communicates with the host apparatus 201, and a buffer memory 101 which temporary stores printing data to be printed on a card and record data to be magnetically or electrically recorded on a magnetic stripe or an accommodating IC of a card.

Further, the external bus is connected to a sensor controller 103 which controls a signal from various sensors, an actuator controller 104 which includes a motor driver for supplying drive pulse and drive power to each of motors, a thermal head controller 105 which controls thermal energy supplied to the heating elements structuring the thermal head 40, an operation display unit 106 which controls the operation panel 5, and the information recording unit A described above.

[Power Source]

The power source 120 supplies operating and driving power to the controller 100, the thermal head 40, the heat roller 33, the operation panel 5, and the information recording unit A.

[Transfer Sequence and Decurl Processing]

Figure 12:
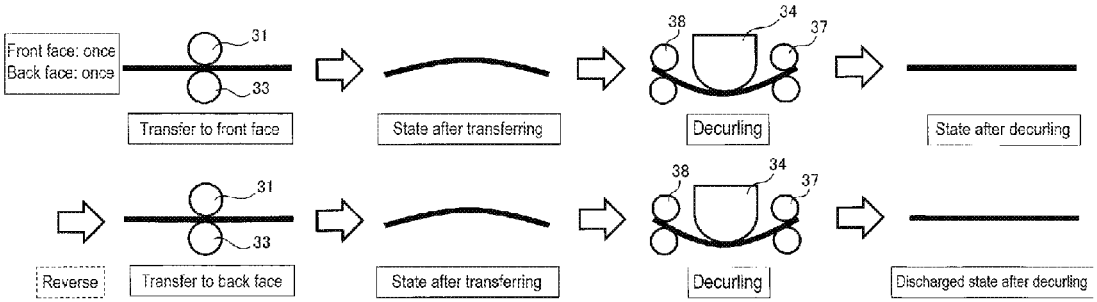
FIG. 12 is an explanatory view schematically illustrating a conventional decurl operation in which decurl processing is performed for each transfer processing at duplex transferring.
Figure 13:
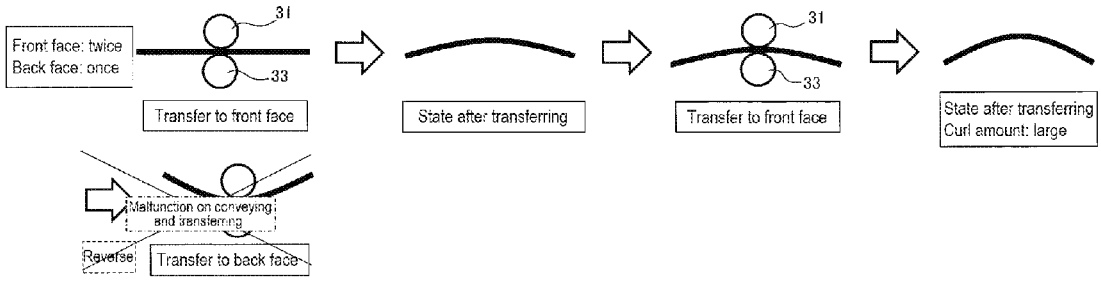
FIG. 13 is an explanatory view illustrating a conventional problem which occurs when transfer processing is continuously performed on a same face of the card without performing decurl processing with the decurl mechanism.

Next, transfer processing with the printing unit B of the printing apparatus 1 according to the present embodiment and decurl processing with the decurl mechanism 10 will be described. When transfer processing is performed on a card-shaped recording medium as in the present embodiment, the card is curled due to contraction of the transfer film 46 transferred to the card. For example, when transfer processing is performed twice continuously on the front face without performing decurl processing in a case that transferring processing is performed twice on the front face and once on the back face (see FIG. 13), there is a fear that negative influence occurs on conveying and transfer processing on the back face as a curl of the card is enlarged due to transfer processing. This is because even though a curl due to transfer processing of one time has no influence, a curl is accumulated to be enlarged when transfer processing is performed twice continuously. Accordingly, conventionally, decurl processing with the decurl mechanism 10 is performed after transfer processing is performed on the front face of the card, as illustrated in FIG. 12. Then, the card is reversed and transfer processing is performed on the back face. Finally, decurl processing with the decurl mechanism 10 is performed again and the card is discharged. However, in the present embodiment, since transfer processing is performed for a plurality of times at least on one face of the card, decurl processing has to be performed for the same times as transferring processing when card issuing is performed with the conventional method. As decurl processing on the card with the decurl mechanism 10 increases, damage to the card may increase.

In the present embodiment, whether decurl processing with the decurl mechanism 10 is performed after transfer processing is performed is determined from a transfer face on which transfer processing has been currently performed, a transfer face on which transfer processing is performed subsequently, and a current state of a curl. Thus, damage to the card is lessened by not performing unnecessarily decurl processing with the decurl mechanism 10.

In the present embodiment, the controller 100 counts a curl level value of the card so as to count up or count down the curl level value in accordance with transfer processing with the transfer unit B2 and decurl processing with the decurl mechanism 10. In the present embodiment, the curl level value is incremented by one (hereinafter, +1) when transfer processing is performed on the front face of the card and decremented by one (hereinafter, −1) when transfer processing is performed on the back face of the card. Further, the curl level value is decremented by one when decurl processing is performed with the decurl mechanism 10 for a curl which occurred through transfer processing on the front face of the card, and the curl level value is incremented by one when decurl processing is performed with the decurl mechanism 10 for a curl which occurred through transfer processing on the back face of the card. That is, the curl level value is to be zero when decurl processing is performed (curl level value −1) after transfer processing is performed (curl level value +1) on the front face of the card, so that the card is not curled. In contrast, the curl level value is to be zero when decurl processing is performed (curl level value +1) after transfer processing is performed (curl level value −1) on the back face of the card, so that the card is not curled. Further, the curl level value is to be zero when transfer processing is performed (curl level value −1) on the back face of the card without performing decurl processing after transfer processing is performed (curl level value +1) on the front face of the card, so that the card is not curled in the same manner.

When transfer processing is performed twice continuously on the front face of the card without performing decurl processing with the decurl mechanism 10, the curl level value becomes to two, so that there is a high possibility that negative influence occurs on conveying and transfer processing on the back face as a curl of the card is enlarged. Further, the curl level value becomes to minus two when transfer processing is performed twice continuously on the back face of the card, so that a curl of the card is enlarged in the same manner. Accordingly, in the present embodiment, timing to perform decurl processing with the decurl mechanism 10 is determined and executed so that the curl level value does not become equal to or more than two or equal to or less than minus two.

For example, in a case that transfer processing is performed twice on each of the front face and the back face of the card, there are six types of patterns of sequence of transfer processing, as illustrated in FIG. 9. In pattern 1, transfer processing is performed in the order of the front face, the back face, the front face, and the back face, so that the curl level value is incremented and decremented as +1, −1 (here, a curl is balanced out), +1, and −1 (here, a curl is balanced out). Thus, a curl is balanced out through transfer processing on the front face and the back face of the card without performing decurl processing with the decurl mechanism 10. Here, the curl level values shown in FIGS. 7 to 10 indicate the curl level values after transfer processing and decurl processing are performed, if performed, and a double circle shown in the line of "Decurling" indicates that decurl processing is performed with the decurl mechanism 10. In patterns 2 to 4 shown in FIG. 9, since a curl is balanced out respectively through the first transfer processing and the second transfer processing, and the third transfer processing and the fourth transfer processing, similarly to pattern 1, decurl processing with the decurl mechanism 10 is unnecessarily.

In pattern 5, transfer processing is performed in the order of the front face, the front face, the back face, the and back face, so that the curl level value becomes to two if decurl processing is not performed with the decurl mechanism 10 between the first transfer processing and the second transfer processing. Accordingly, decurl processing is performed with the decurl mechanism 10 after the first transfer processing is performed. Transfer processing and decurl processing are performed in the following order in pattern 5 as transfer processing on the front face (curl level value incremented by one), decurl processing (curl level value decremented by one to be zero; curl corrected), transfer processing on the front face (curl level value incremented by one), transfer processing on the back face (curl level value decremented by one to be zero; curl balanced out), and transfer processing on the back face (curl level value decremented by one). As the card remains curled with the curl level value still being minus one, decurl processing is performed with the decurl mechanism 10 once again at the end (curl level value incremented by one to be zero; curl corrected). Thus, the card is discharged with a curl corrected. As described above, decurl processing with the decurl mechanism 10 is performed twice in pattern 5 being reduced compared to four times in the conventional method.

Similarly in pattern 6, transfer processing and decurl processing are performed in the order of transfer processing on the back face (curl level value decremented by one), decurl processing (curl level value incremented by one to be zero; curl corrected), transfer processing on the back face (curl level value decremented by one), transfer processing on the front face (curl level value incremented by one to be zero; curl balanced out), transfer processing on the front face (curl level value incremented by one), and decurl processing (curl level value decremented by one to be zero; curl corrected), so that decurl processing with the decurl mechanism 10 is performed twice.

As described above, in the present embodiment, the timing to perform decurl processing with the decurl mechanism 10 is determined so that the curl level value does not become equal to or more than two or equal to or less than minus two, and further, the decurl mechanism 10 is controlled to perform decurl processing so that the curl level value becomes to zero when the card is to be discharged.

FIG. 7 shows sequence of transfer processing and timing of decurl processing, in a case that transfer processing is performed twice on the front face of the card and once on the back face. In pattern 1, transfer processing is performed in the order of the front face, the back face, and the front face, and decurl processing with the decurl mechanism 10 is performed after the third transfer processing is performed on the front face. Thus, a curl is corrected and the card is discharged. In pattern 2, transfer processing is performed in the order of the front face, the front face, and the back face, and decurl processing is performed after the first transfer processing is performed on the front face. In pattern 3, transfer processing is performed in the order of the back face, the front face, and the front face, and decurl processing is performed after the third transfer processing is performed on the front face.

FIG. 8 shows sequence of transfer processing and timing of decurl processing, in a case that transfer processing is performed for three times on the front face of the card and once on the back face. In pattern 1, transfer processing is performed in the order of the front face, the back face, the front face, and the front face, and decurl processing is performed after the third transfer processing is performed on the front face and after the fourth transfer processing is performed on the front face. In patterns 2 to 4, transfer sequence and decurl processing are performed as shown in FIG. 8 as well.

FIG. 10 shows sequence of transfer processing and timing of decurl processing, in a case that transfer processing is performed for three times on the front face of the card and twice on the back face. In pattern 1, transfer processing is performed in the order of the front face, the back face, the front face, the back face, and the front face, and decurl processing is performed after the fifth (last) transfer processing is performed on the front face. Here, decurl processing is performed once in pattern 2 to 7 as being similar to pattern 1. On the other hand, decurl processing is performed for three times in pattern 8 and pattern 9, respectively. Even when transfer sequence is set to the order of the front face, the front face, the front face, the back face, and the back face as pattern 8 owing to the structure of the ink ribbon 41 or the like, decurl processing with the decurl mechanism 10 is performed only after the first transfer processing, the second transfer processing, and the fifth transfer processing, so that the number of times of decurl processing is reduced. The above is similar as well in pattern 9.

Here, a determination flow of whether to perform decurl processing is described. First, the CPU determines whether transfer processing is to be performed on the front face or the back face (step St6 in FIG. 11). The curl level value is incremented by one if the transfer face is the front face (step St7) and decremented by one if the transfer face is the back face (step St8), and the curl level value is stored in a memory. Then, it is determined, with reference to a remaining transfer request, whether there is a subsequent transfer processing (step St9). If there is a subsequent transfer processing, it is determined whether the subsequent transfer face is the same with the transfer face on which transfer processing has been currently performed (step St10). When being the same (i.e., front face after front face or back face after back face), the curl level value stored in the memory is referred (step St11).

When the curl level value is zero, the control proceeds to the subsequent transfer processing (step St5) without performing decurl processing with the decurl mechanism 10. When the curl level value is one, decurl processing with the decurl mechanism 10 is performed (step St12) to return the curl level value to zero by decrementing by one (step St13) owing to that the curl level value becomes to two with the subsequent transfer processing if decurl processing is not performed. Then, the control proceeds to the subsequent transfer processing (step St5). When the curl level value is minus one, decurl processing is performed with the decurl mechanism 10 (step St14) to return the curl level value to zero by incrementing by one (step St15) owing to that the curl level value becomes to minus two with the subsequent transfer processing if decurl processing is not performed. Then, the control proceeds to the subsequent transfer processing (step St5). Here, when the subsequent transfer face is different from the current transfer face, the card is reversed without performing decurl processing (step St16).

When it is determined that there is not a remaining transfer request in step St9, the curl level value after transfer processing is completed is referred to determine whether the curl level value is zero (step St17). In a case that the curl level value is zero, the card is discharged as it is as the card is not curled (step St19). In a case that the curl level value is one or minus one, decurl processing is performed with the decurl mechanism 10 (step St18) to correct a curl, and then, the card is discharged (step St19).

With application of the determination flow, the timing of decurl processing can be determined in all patterns of the transfer sequence shown in FIGS. 7 to 10.

[Operation]

Figure 11:
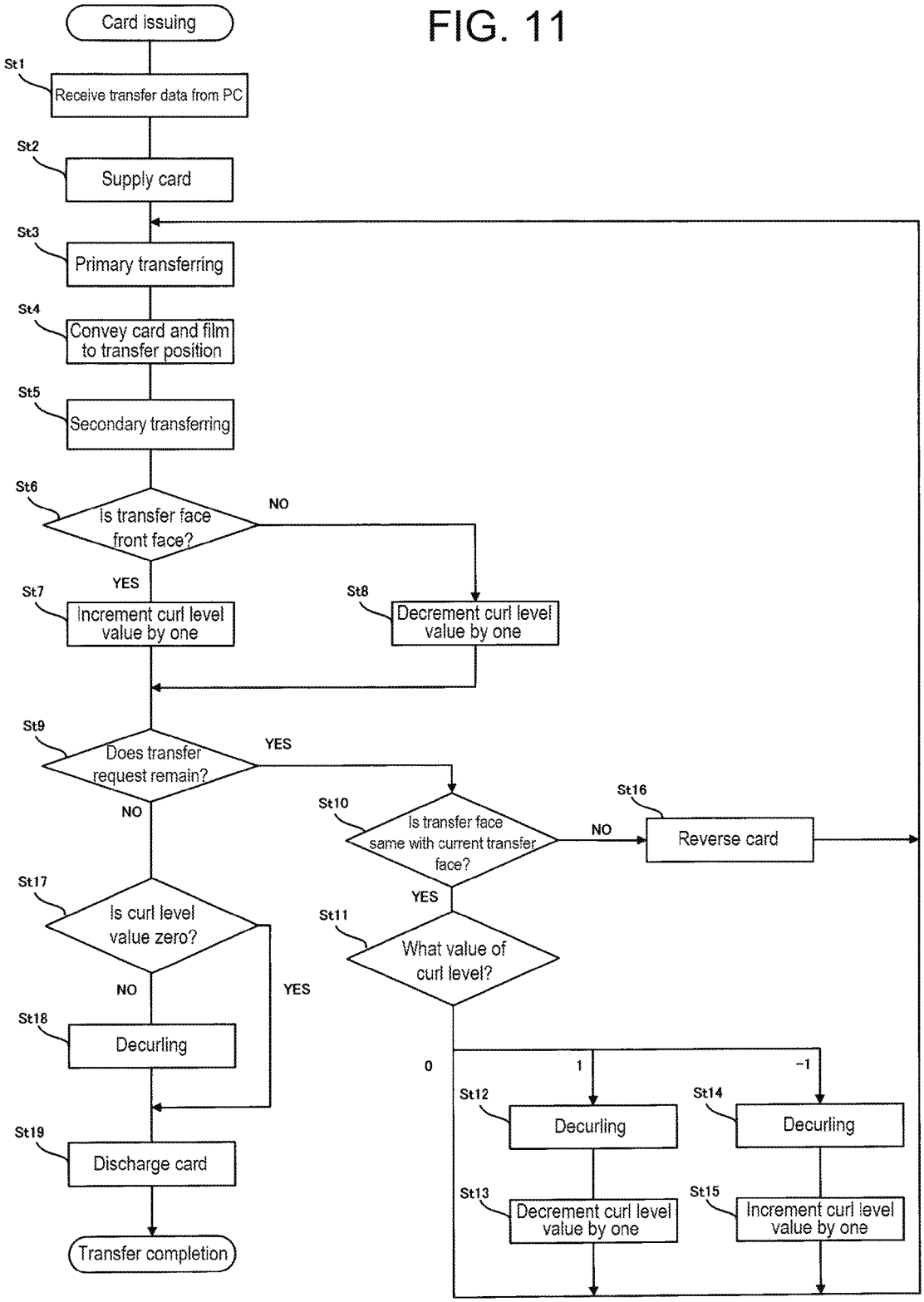
FIG. 11 is a flowchart illustrating a routine for card issuing performed by a CPU of a microcomputer of the controller of the printing apparatus according to the embodiment.

Next, a card issuing operation of the printing apparatus 1 of the present invention will be described with reference to the flowchart illustrated in FIG. 11 mainly on the control of the printing unit B and the decurl mechanism 10 subjectively performed by the CPU of the microcomputer 102 (hereinafter, simply called CPU). The flowchart of the present embodiment describes a flow of the transfer sequence of pattern 2 (i.e., the front face 1, the front face 2, the back face 1, and the front face 3) in which transfer processing is performed for three times on the front face of the card and once on the back face as shown in FIG. 8.

First, the CPU receives transfer data from the host apparatus (PC) 201 (step St1). Since each of transfer data for the front face of the card and the transfer data for the back face is sent from the host apparatus 201, the CPU can perceive transfer sequence to the card. Here, the transfer sequence may be designated by a user and the CPU may receive the information from the host apparatus 201, or may be determined by the CPU in accordance with the transfer data received from the host apparatus 201 and the type of the ink ribbon 41.

When the transfer data is received from the host apparatus 201, a card is supplied (step St2). Concurrently with the card supply, transfer data for the front face 1 is formed on the transfer film 46 at the image forming unit B1 (primary transferring: step St3). When the primary transferring is completed, the card and the transfer film 46 are conveyed respectively to the transfer starting position (step St4) at the transfer unit B2, and secondary transferring is started (step St5). Here, the CPU determines whether transfer processing has been currently performed on the front face or the back face of the card (step St6). Since transfer processing has been currently performed on the front face of the card, the curl level value is incremented by one from the initial value zero and stored in the memory as one (step St7).

Then, the CPU determines whether there remains a transfer request (step St9). Since the subsequent transfer processing is to be performed on the front face 2, it can be acknowledged that the subsequent transfer face is the same front face as the current transfer face (step St10). Then, decurl processing with the decurl mechanism 10 is performed as the current curl level value is one (step St12). The curl level value is updated to zero as decrementing the current curl level value by one (step St13) and stored in the memory.

Subsequently, the transfer data for the front face 2 is formed on the transfer film 46 at the image forming unit B1 (step St3), the card and the transfer film 46 are conveyed to the transfer unit B2 (step St4), and transfer processing for the front face 2 is started at the transfer unit B2 (step St5). Since transfer processing has been performed on the front face of the card again (step St6), the curl level value is incremented by one and stored in the memory as one (step St7). Since the subsequent transfer processing is to be performed on the back face 1, the control proceeds to "YES" in step St9 and the subsequent transfer face of transfer processing is determined (step St10). As described above, the subsequent transfer face is the back face being different from the front face on which transfer processing has been currently performed. Accordingly, the card is reversed (step St16) and the control proceeds to the subsequent transfer processing.

Subsequently, transfer data for the back face 1 is formed on the transfer film 46 at the image forming unit B1 (step St3), the card and the transfer film 46 are conveyed to the transfer unit B2 (step St4), and transfer processing for the back face 1 is started at the transfer unit B2 (step St5). Since transfer processing has been currently performed on the back face (step St6), the current curl level value being one is decremented by one and stored in the memory as zero (step St8). Here, a curl of the card is balanced out through transfer processing for the front face 2 and transfer processing for the back face 1.

Since the transfer request for the front face 3 remains, the control proceeds to "YES" in step St9 and the subsequent transfer face and the current transfer face are compared (step St10). Here, since the subsequent transfer face is the front face being different from the current transfer face, the card is reversed without performing decurl processing (step St16). Subsequently, transfer data for the front face 3 is formed on the transfer film 46 at the image forming unit B1 (step St3), the card and the transfer film 46 are conveyed to the transfer unit B2 (step St4), and transfer processing for the front face 3 is started at the transfer unit B2 (step St5). Since transfer processing has been performed on the front face of the card (step St6), the curl level value is incremented by one from zero and stored in the memory as +1 (step St7).

Then, the CPU determines whether there is a remaining transfer request (step St9). The control proceeds to "NO" in step St9 as transfer processing is determined as completed. At this time, it is determined whether the current curl level value is zero (step St17). Then, decurl processing is performed with the decurl mechanism 10 owing to that the curl level value is one. Thus, a curl is corrected and the curl level value becomes to zero. The card with a curl corrected is discharged to the accommodating stacker 60 (step St19) and card issuing is completed.

In the present embodiment, whether decurl processing with the decurl mechanism 10 is performed is determined from the current transfer face, the subsequent transfer face, and a curl history as counting the curl level value. However, the tables shown in FIGS. 7 to 10 may be previously stored in the memory and a corresponding pattern of the transfer sequence may be read out as the transfer sequence for the front face the and back face of the card is determined, and then, transfer processing and decurl processing may be performed.

Further, whether to perform decurl processing may be determined by case division without using the curl level value. An example will be described in a case that transfer processing is performed for three times on a card.

First, in a case that transfer processing is performed on different transfer faces in the first transfer processing and the second transfer processing, the second transfer processing is performed with the card reversed after the first transfer processing is performed without performing decurl processing. On the other hand, in a case that transfer processing is performed on the same transfer face in the first transfer processing and the second transfer processing, the second transfer processing is performed with decurl processing performed after the first transfer processing is performed.

Then, in a case that decurl processing is not performed after the first transfer processing, the card is determined as not being curled after the second transfer processing. Accordingly, the third transfer processing is performed without performing decurl processing. On the other hand, in a case that decurl processing is performed after the first transfer processing is performed and transfer processing is performed on the same transfer face in the second transfer processing and the third transfer processing, the card is determined as not being curled after the second transfer processing. Accordingly, the third transfer processing is performed after decurl processing is performed. Further, in a case that decurl processing is performed after the first transfer processing and transfer processing is performed on different transfer faces in the second transfer processing and the third transfer processing, the third transfer processing is performed with the card reversed after the second transfer processing is performed without performing decurl processing.

Thus, whether to perform decurl processing may be determined by determining whether the card is curled after the current transfer processing while managing the processing history without using the curl level value.

Here, in the present embodiment, the curl level value is set not to become equal to or more than two or equal to or less than minus two. However, in an apparatus which does not receive influence on conveying and transfer processing even when the curl level value is two or minus two, the curl level value may be set not to become equal to or more than three or equal to or less than minus three. In this case, the subsequent transfer processing is performed without performing decurl processing when the curl level value is zero, one, or minus one in step St11 in FIG. 11, decurl processing is performed when the curl level value is two in step St12, and decurl processing is performed when the curl level value is minus two in step St14. In decurl processing in step St18, decurl processing may be performed so that the curl level value becomes to zero.

Here, the present invention may be applied to a laminating apparatus which includes only the transfer unit B2 without the image forming unit B1. In this case, an image may be previously formed on the transfer film 46 and transfer processing may be performed for a plurality of times on at least one face of a card. Here, the image may be formed on the transfer film 46 with another apparatus, or a protection film such as a hologram film may be used.

Incidentally, the present application claims priorities from Japanese Patent Application No. 2015-123672, the contents of which are incorporated herein by reference.

What is claimed is:

1. A transfer apparatus, comprising:

a transfer device which performs transfer processings to transfer a transfer layer of a transfer film or a protection film for a plurality of times on at least one of a first face of a card-shaped recording medium and a second face of the card-shaped recording medium;

a correcting device which performs a decurl processing to correct a curl of the recording medium to which the transfer layer is transferred with the transfer device;

a comparing device which determines, to the recording medium, whether a transfer face of the recording medium on which a current transfer processing is performed and a transfer face of the recording medium on which a subsequent transfer processing is to be performed with the transfer device are same or not; and a control device which controls the transfer device and the correcting device, wherein the control device determines whether to perform the decurl processing with the correcting device after the current transfer processing is performed based on information of the transfer faces compared through the comparing device, and information of whether the recording medium is curled after the current transfer processing is performed.

2. The transfer apparatus according to claim 1, wherein the control device performs the decurl processing with the correcting device after the current transfer processing is performed when the control device determines that the transfer face of the recording medium on which the current transfer processing is performed and the transfer face on which the subsequent transfer processing is to be performed are determined to be the same through the comparing device and that the recording medium is curled after the current transfer processing is performed.

3. The transfer apparatus according to claim 2, wherein the control device refers to a curl level value which increases and decreases in accordance with the transfer processing with the transfer device and the decurl processing with the correcting device to determine whether the recording medium is curled.

4. The transfer apparatus according to claim 3, wherein the control device is configured to increment the curl level value when the transfer processing is performed on the first face of the recording medium, decrement the curl level value when the transfer processing is performed on the second face of the recording medium, decrement the curl level value when the decurl processing is performed in a direction to correct a curl occurred through the transfer processing on the first face of the recording medium, and increment the curl level value when the decurl processing is performed in a direction to correct a curl occurred through the transfer processing on the second face of the recording medium; and the control device determines that the recording medium is curled when the curl level value is not zero after the current transfer processing is performed.

5. The transfer apparatus according to claim 2, wherein, based on comparison result of the comparing device, the control device controls the transfer device and the correcting device so that:

a second transfer processing is performed with the recording medium reversed after a first transfer processing is performed without performing the decurl processing in a case that the transfer processing is performed on different transfer faces in the first transfer processing and the second transfer processing with the transfer device;

the second transfer processing is performed with the decurl processing performed after the first transfer processing is performed in a case that the transfer processing is performed on a same transfer face in the first transfer processing and the second transfer processing with the transfer device;

a third transfer processing is performed without performing the decurl processing in a case that the decurl processing is not performed after the first transfer processing is performed, determining that the recording medium is not curled after the second transfer processing is performed;

the third transfer processing is performed after the decurl processing is performed in a case that the decurl processing is performed after the first transfer processing is performed and the transfer processing is performed on a same transfer face in the second transfer processing and the third transfer processing, determining that the recording medium is curled after the second transfer processing; and the third transfer processing is performed with reversing the recording medium reversed after the second transfer processing is performed without performing the decurl processing in a case that the decurl processing is performed after the first transfer processing is performed and the transfer processing is performed on different transfer faces in the second transfer processing and the third transfer processing.

6. The transfer apparatus according to claim 1, wherein when the comparing device determines that the current transfer processing is performed on the first face of the card-shaped recording medium, and the subsequent transfer processing is to be performed on the first face of the card-shaped recording medium, and that the card-shaped recording medium is curled after the current transfer processing is performed, the correcting device performs the decurl processing on the first face of the card-shaped recording medium between the current transfer processing and the subsequent transfer processing; and when the comparing device determines that the current transfer processing is performed on the second face of the card-shaped recording medium, and the subsequent transfer processing is to be performed on the second face of the card-shaped recording medium, and that the card-shaped recording medium is curled after the current transfer processing is performed, the correcting device performs the decurl processing on the second face of the card-shaped recording medium between the current transfer processing and the subsequent transfer processing.

7. The transfer apparatus according to claim 6, wherein when the comparing device determines that the current transfer processing is performed on the first face of the card-shaped recording medium, and the subsequent transfer processing is to be performed on the second face of the card-shaped recording medium, the correcting device does not perform the decurl processing on the first face of the card-shaped recording medium between the current transfer processing and the subsequent transfer processing; and when the comparing device determines that the current transfer processing is performed on the second face of the card-shaped recording medium, and the subsequent transfer processing is to be performed on the first face of the card-shaped recording medium, the correcting device does not perform the decurl processing on the second face of the card-shaped recording medium between the current transfer processing and the subsequent transfer processing.

8. The transfer apparatus according to claim 1, wherein when the comparing device determines that the current transfer processing is performed on the first face of the card-shaped recording medium, and the subsequent transfer processing is to be performed on the first face of the card-shaped recording medium, and that the card-shaped recording medium is not curled after the current transfer processing is performed, the correcting device does not perform the decurl processing on the first face of the card-shaped recording medium between the current transfer processing and the subsequent transfer processing; and when the comparing device determines that the current transfer processing is performed on the second face of the card-shaped recording medium, and the subsequent transfer processing is to be performed on the second face of the card-shaped recording medium, and that the card-shaped recording medium is not curled after the current transfer processing is performed, the correcting device does not perform the decurl processing on the second face of the card-shaped recording medium between the current transfer processing and the subsequent transfer processing.

* * * * *